US005193493A

United States Patent [19]

Ickes

[11] Patent Number: 5,193,493

[45] Date of Patent: Mar. 16, 1993

[54] INTERNAL COMBUSTION ENGINE WITH PISTON VALVING

[76] Inventor: Theodore P. Ickes, P.O. Box 37515, Albuquerque, N. Mex. 87176

[21] Appl. No.: 819,228

[22] Filed: Jan. 10, 1992

[51] Int. Cl.[5] ..... F02B 75/04

[52] U.S. Cl. ..... 123/48 R; 123/51 A

[58] Field of Search ..... 123/48 R, 48 A, 48 AA, 123/78 R, 78 A, 51 R, 51 A, 51 B

[56] References Cited

U.S. PATENT DOCUMENTS

| | | | |
|---|---|---|---|
| 1,557,710 | 10/1925 | Lennon | 123/78 A |
| 1,564,009 | 12/1925 | Myers | 123/78 A |
| 1,812,983 | 7/1931 | Redmond | 123/78 R |
| 1,848,597 | 3/1932 | Arnold | 123/78 A |
| 2,563,885 | 8/1951 | Tatter | 123/78 A |
| 4,148,284 | 4/1979 | Prosen | 123/78 AA |
| 4,321,904 | 3/1982 | Bristol | 123/48 R |
| 4,625,684 | 12/1986 | Van Avermaete | 123/48 A |
| 4,708,096 | 11/1987 | Mroz | 123/48 A |

FOREIGN PATENT DOCUMENTS

| | | | |
|---|---|---|---|
| 3107382 | 10/1982 | Fed. Rep. of Germany | 123/78 A |
| 0029747 | 2/1987 | Japan | 123/48 R |

*Primary Examiner*—David A. Okonsky

[57] ABSTRACT

An internal combustion engine in which the combustion chamber volume is reduced during the movement of the power piston in its compression and power stroke. This permits delaying the time or maximum combustion pressure, due to the ignition and expansion of the compressed fuel/air charge, until the power piston is well past top dead center (TDC), 35 degrees after TDC for example. One advantage to this mode of operation is that the engine crankshaft journal has moved to a position where the axis of the journal is more offset, compared to at or near TDC, from the axis of rotation of the crankshaft so engine torque is increased. This is accomplished by a pair of half round valving pistons mounted in a bore in the cylinder head. The axis of the cylinder head bore coincides with the axis of the engine block bore in which the power piston moves. A camshaft assembly mounted in the cylinder head includes cam discs that are connected to the valving pistons. The cam discs move the valving pistons in a reciprocating manner that adjusts the size of the combustion chamber and opens and closes intake and exhaust ports formed in the walls of the combustion chamber. Downward movement of the valving pistons begins when the power piston approaches TDC and continues during the initial downward movement of the power piston durings its power stroke. This results in a secondary compression that adds to the compression due to the power piston and also slows the rate at which the combustion chamber increases in volume due to downward movement of the power piston. A cylinder head constructed in accordance with this invention could be adapted to existing engines.

4 Claims, 1 Drawing Sheet

INTERNAL COMBUSTION ENGINE WITH PISTON VALVING

BACKGROUND OF THE INVENTION

1. Field of the Invention

This invention is in the field of internal combustion engines and more particularly the invention relates to a new and improved valving means for such engines.

2. Description of the Prior Art

Previous internal combustion engines have included means for maintaining a substantially constant combustion chamber volume during the downward combustion stroke of the power or working piston. This has been accomplished by placing one or two auxillary pistons in a bore or cylinder above the power piston and moving the auxillary pistons in conjunction with the power piston to maintain the volume of the combustion chamber constant. Various types of valving have been used in these engines. In some engines conventional cam opened, spring closed valves have been mounted in the auxillary piston above the power piston. In others the valves are mounted in the cylinder block or head and positioned so as to be in communication with the combustion chamber. In all of the prior art engines known to Applicant either the valves are spring closed or the auxillary pistons used to maintain constant combustion chamber are spring biased against a cam that moves them in one direction in the cylinder of an engine. It is well known that spring closed valves result in valve float, i.e. the valves do not close completely, when the engine is operated at high revolutions. No doubt similar float would occur if an engine employing spring biased auxillary pistons was operated at high revolutions.

SUMMARY OF THE INVENTION

A primary object of this invention is to provide an internal combustion engine having a valving mechanism that results in aspiration of the engine and reduces the combustion chamber volume during portions of the compression and power stroke of the power piston.

Another object of the invention is to provide a valving mechanism that does not utilize springs to cause movement of the moving parts of the valving mechanism.

Another object of the invention is to provide an engine wherein increased engine torque is achieved because the maximum combustion pressure is delayed until about 35 degrees after top dead center(TDC). This is a position where the crankshaft journal is more offset, compared to at or near top dead center, from the axis of rotation of the crankshaft so the piston force has a larger lever arm on the crankshaft.

Yet another object of the invention is to provide an engine that will accept a wide range of fuels, gasoline and diesel for example, and gasoline of various octane ratings.

These and other objects of the invention are achieved by mounting two half round or semicircular valving pistons in a bore in a cylinder head mounted on the cylinder block of an engine. The half round pistons each have a cam slot cut in their upper skirt sections. A cam track follower is mounted on each piston so that it protrudes into the cam slot. The cylinder head bore is aligned with the cylinder block bore, that is the longitudinal axes of the two bores would coincide if extended along imaginary lines. A camshaft mounted on the cylinder head is driven by the crankshaft. A pair of cam discs mounted on the camshaft, for rotation with the camshaft, are positioned so that the peripheries of the two discs extend down into the bore in the cylinder head. Each cam disc has a cam groove or cam track formed in the periphery thereof that receives the cam track follower of one of the half round pistons. The cam tracks are configured so that rotation of the cam discs will result in reciprocating motion of the valving pistons to adjust the size of the combustion chamber as well as open and close exhaust and intake ports formed in the wall of the combustion chamber.

DETAILED DESCRIPTION OF THE PREFERRED EMBODIMENT

Figure 1:
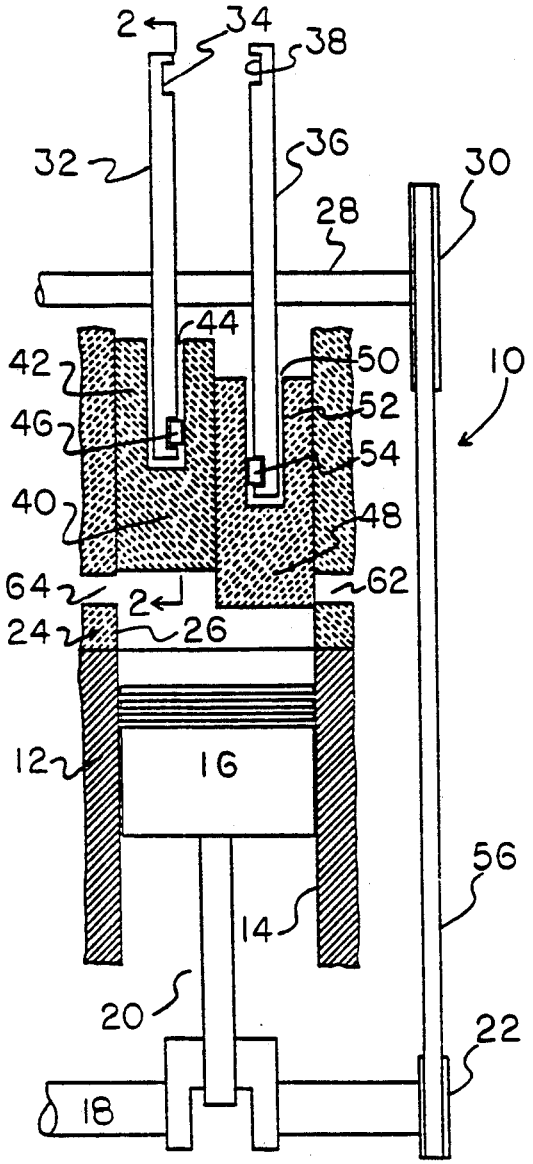
FIG. 1 is a schematic elevation view, partially in section, showing the arrangement of the valving pistons in relation to the power piston, and the cam discs that drive the valving pistons.

FIG. 1 discloses an internal combustion engine 10 having a cylinder block 12 that includes at least one cylinder bore 14. While only one cylinder is shown in this application to simplify the illustration and description it will be readily apparent to one skilled in this art that the invention could be applied to a multicylinder engine. A crankshaft assembly mounted in the cylinder block includes power piston 16 slidably disposed in bore 14, crankshaft 18, and connecting rod 20 that interconnects piston 16 and crankshaft 18. A drive gear or sprocket 22 is mounted on an end of the crankshaft utilized for driving the camshaft of the engine. A cylinder head 24 is mounted on the cylinder block in a conventional manner, not shown. The cylinder head has a bore or bores 26 formed therein. The number of bores corresponds to the number of bores 14 in the cylinder block. A camshaft assembly mounted on the cylinder head in a conventional manner, not shown, includes a camshaft 28 and a drive sprocket or gear 30 mounted on one end of the camshaft. An intake cam disc 32 mounted on the camshaft for rotation therewith has a cam track 34 cut in the periphery thereof. An exhaust cam disc 36 having cam track 38 is mounted on camshaft 28. The cam discs are positioned such that cam tracks 34 and 38 face each other and extend downwardly into the cylinder head bore.

A half round or semicircular intake valving piston that includes skirt section 42 is slidably mounted in bore 26. A slot 44 is formed in skirt section 42 to accommodate cam disc 32. A cam track follower 46 is mounted on piston 40 in a position to ride in cam track 34. Half round exhaust valving piston 48 is slidably disposed in bore 26 alongside valving piston 40 so that their flat sides abut one another. Valving piston 48 has a slot 50 cut in skirt 52 to accommodate cam disc 36. A cam follower 54 rotatably mounted on piston 48 rides in cam track 38 of cam disc 36. Camshaft gear 30 and crankshaft gear 22 are shown connected by a belt 56, but it should be understood that gears, sprockets and a chain, or gears and a belt could be used to drive the camshaft assembly from the crankshaft.

Figure 3:
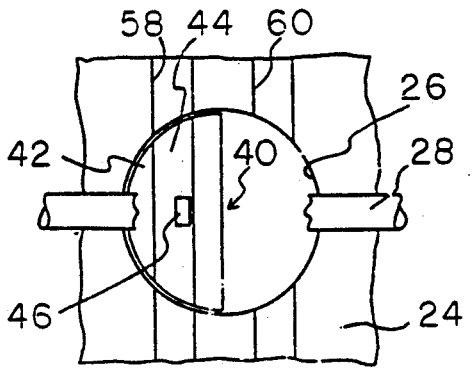
FIG. 3 is top view of FIG. 1 showing the cam slot in the intake valving piston. The exhaust valving piston is removed in this Figure.

Preferably the cylinder head bore has a ceramic liner and the half round valving pistons are made of a ceramic material. In the event the cylinder head or pistons were made of metal it would be necessary to provide sealing means between the sliding surfaces. Such sealing means are known in the art. Cylinder head 24 has slots 58 and 60, see FIG. 3, to accommodate cam discs 32 and 36 when the camshaft assembly is installed on the cylinder head.

Figure 2:
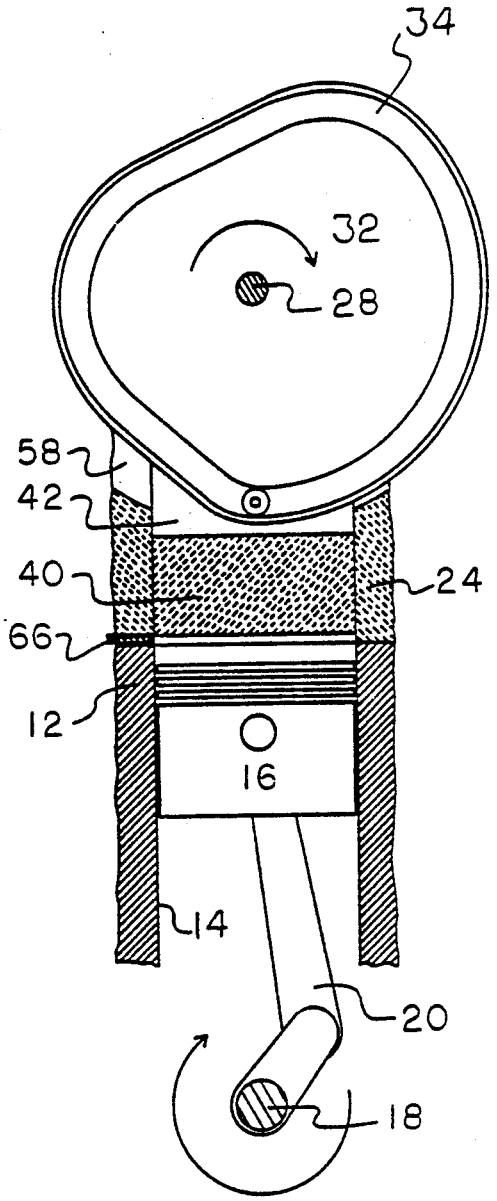
FIG. 2 is a partially sectioned view taken along lines 2—2 of FIG. 1. which illustrates the intake valving piston and the configuration of the cam track in the intake cam disc.
Figure 4:
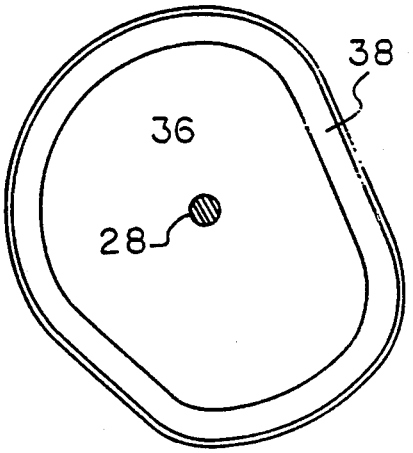
FIG. 4 illustrates the configuration of the cam track in the exhaust valve disc.

FIG. 2 illustrates the configuration of the cam track in intake cam disc 32 and FIG. 4 the configuration of the cam track in exhaust cam disc 36. The cam tracks are configured to cause downward movement of the valving pistons just as the power piston approaches TDC, and continued downward movement of the valving pistons during the initial downward movement of the power piston in its power stroke. This results in a secondary compression, which is compression due to downward motion of the valving pistons, that adds to the primary compression due to power piston movement. Downward movement of the valving pistons also slows the rate at which the combustion chamber increases in volume due to downward movement of the power piston.

As shown in FIG. 1 valving piston 48 is in a position where it closes exhaust port 62 in bore 26 and valving piston 40 is in a position that opens intake port 64. A threaded hole 66 in cylinder head 24 is in communication with bore 26 in the area that forms part of the engine combustion chamber. A sparkplug or other suitable ignition device can be installed in threaded hole 66. For example if the invention was utilized in a diesel engine that did not require sparkplugs then hole 66 could be used to install glow plugs for cold starting.

The operation of the engine is as follows, assuming the engine is a four cycle gasoline engine and that the power piston is at TDC after completion of the intake stroke and primary compression. At this time both of the valving pistons would be level with each other(not shown) closing both the intake and exhaust ports. The fuel/air charge has been compressed in the combustion chamber defined by the bottom surface of the valving pistons and the upper surface of the power piston. When the crankshaft rotates past TDC and the power piston starts down the valving pistons have already moved downwardly a slight amount toward the power piston to cause secondary compression. Continued downward movement of the valving pistons results in the volume of the combustion chamber being reduced during this first portion of the power pistons downward movement to prolong the compression stroke. Ignition occurs somewhere between TDC and 35 degrees after TDC depending upon engine speed and load. Maximum combustion chamber pressure occurs at 35 degrees after TDC. While the combustion pressure forces the power piston to bottom dead center the two valving pistons remain in their bottom position. The maximum combustion pressure position of the power piston is approximately as shown in FIG. 2. In this position the crankcase journal is offset considerably from the axis of rotation of the crankshaft. This results in the power piston exerting increased torque on the crankshaft during the power stroke. When the power piston starts back up again in it's exhaust stroke the intake valving piston remains in position to close the intake port and the exhaust valving piston is moved upwardly to open the exhaust port. When the power piston passes TDC and starts down on the intake stroke the exhaust port is closed and the intake port is opened. The intake port is closed shortly after the power piston passes BDC and starts up on the compression stroke. Both ports are closed through the compression stroke and the power stroke.

This completes the detailed description of a preferred embodiment of the invention. However it will be apparent to those skilled in the art that some changes and modifications can be made to the invention without departing from the spirit and scope of the invention as defined in the claims appended hereto. For example, turbulence within the combustion chamber can be increased by appropriate cam design and properly shaping the faces of the valving pistons and power pistons to shape the combustion chamber. Increased turbulence results in a more homogeneous fuel/air mixture which improves combustion to lower engine exhaust emissions. Also the exact opening and closing of the intake and exhaust ports in relation to power piston position, and overlap in the opening and closing of the ports, would vary in accordance with engine design. Also for some engine designs it may be desireable to make one valving piston larger and/or larger than the other.

What is claimed is:

1. An internal combustion engine in which compression is prolonged and maximum combustion chamber pressure is delayed, said engine having a cylinder block with at least one cylinder bore formed therein, crankshaft means rotatably mounted in said cylinder block, reciprocating power piston means slidably mounted in the cylinder block bores and rotatably mounted on the crankshaft, and cylinder head means mounted on said cylinder block that includes valve means operatively connected to the crankshaft so as to be driven thereby, said valve means comprising:

at least one bore formed in said cylinder head having intake and exhaust ports in each cylinder head bore, said cylinder head bores having substantially the same diameter as said cylinder block bores and positioned so that the longitudinal axes of the cylinder head and block bores are aligned and the upper portions of the cylinder block bores and the lower portions of the cylinder head bores form the combustion chambers of the engine;

a pair of half round valving piston means slidably mounted in each cylinder head bore for adjusting the volume of the combustion chamber, and for filling the combustion chamber with a fuel/air charge and exhausting the combustion products therefrom;

camshaft means rotatably mounted on said cylinder head means and connected to said crankshaft means so as to be driven thereby, said camshaft means including cam disc means mounted thereon for rotation therewith and connected to each of said valving piston means whereby the rotation of said camshaft means will result in reciprocating motion of said half round valving pistons to cause a secondary compression that adds to the primary compression due to movement of the power piston and minimum combustion chamber volume occurs when the power piston is positioned between top dead center and 35 degrees after top dead center.

2. The internal combustion engine recited in claim 1 which further includes:

a cam groove formed in each cam disc means, and a rotatably mounted cam groove follower means mounted on each of said valving piston means and positioned so that the cam groove followers travel in the cam grooves to cause reciprocating motion of said valving piston means when the cam disc means are rotated.

3. The internal combustion engine recited in claim 2 wherein:

said half round valving piston means slidably mounted in said cylinder head bores are made of a ceramic material, and a ceramic sleeve is mounted in each of the cylinder head bores to provide a ceramic wall for the cylinder in which the half round valving piston means slide.

4. An internal combustion engine in which the compression stroke can be prolonged and maximum combustion pressure in the combustion chamber can be delayed to well past top dead center, said engine comprising:

a cylinder block having at least one cylinder bore, and a crankshaft means that includes at least one piston means mounted in said cylinder block so that the piston means is slidably disposed in the cylinder bore;

a cylinder head means mounted on said cylinder block, said cylinder head means having at least one bore formed therein that is substantially the same diameter as the bore in said cylinder block and positioned so that the longitudinal axes of the bore in the cylinder head and the cylinder block coincide thereby forming a combustion chamber in the lower end of the bore in the cylinder head and the upper end of the bore in the cylinder block;

intake and exhaust port means formed in each combustion chamber for admitting a fuel/air charge thereto and exhausting combustion products therefrom;

ignition means mounted on said engine and connected to said combustion chamber for igniting a fuel/air charge therein;

camshaft means mounted on said cylinder head means and connected to said crankshaft means so as to be rotated thereby;

at least one exhaust cam disc having a cam groove formed in the periphery thereof mounted on said camshaft means for rotation therewith, at least one intake cam disc having a cam groove formed in the periphery thereof mounted on said camshaft means for rotation therewith, said intake cam disc being mounted in a position adjacent to said exhaust cam disc, and both cam discs being positioned so that the peripheries thereof extend down into the bores formed in said cylinder head;

a half round exhaust valving piston means mounted in each bore in the cylinder head that includes a cam groove follower that is positioned in the cam groove of said exhaust cam disc;

a half round intake valving piston means mounted in each bore in the cylinder head in a position adjacent the exhaust valving piston, said intake valving piston having a cam groove follower that is positioned in the cam groove formed in the intake cam disc so that when the cam discs are rotated the two pistons will slide in the cylinder head bore together and also slide relative to each other, the motion of said intake and exhaust valving piston means being controlled by the configuration of said cam grooves.

* * * * *